US007080457B2

(12) United States Patent
Sullivan

(10) Patent No.: US 7,080,457 B2
(45) Date of Patent: Jul. 25, 2006

(54) SPRING ASSISTED FOLDING KNIFE

(76) Inventor: Scott Sullivan, 3 Garden Ridge, Chappaqua, NY (US) 10514

( * ) Notice: Subject to any disclaimer, the term of this patent is extended or adjusted under 35 U.S.C. 154(b) by 0 days.

(21) Appl. No.: 10/459,053

(22) Filed: Jun. 10, 2003

(65) Prior Publication Data

US 2003/0226260 A1 Dec. 11, 2003

Related U.S. Application Data

(60) Provisional application No. 60/387,658, filed on Jun. 10, 2002.

(51) Int. Cl.
*B26B 3/06* (2006.01)

(52) U.S. Cl. ..... 30/160; 30/161

(58) Field of Classification Search ..... 30/161, 30/160

See application file for complete search history.

(56) References Cited

U.S. PATENT DOCUMENTS

| | | | | |
|---|---|---|---|---|
| 551,052 | A | 12/1895 | Shonnard et al. | |
| 552,928 | A | 1/1896 | Russell | |
| 616,689 | A | 12/1898 | Ruettgers | |
| 1,603,914 | A | 10/1926 | Hermann | |
| 1,701,027 | A | 2/1929 | Brown | |
| 2,407,897 | A | 9/1946 | Newman | |
| 3,868,774 | A | 3/1975 | Miori | |
| 4,451,982 | A | 6/1984 | Collins | |
| 4,573,268 | A * | 3/1986 | Call | 30/161 |
| 4,604,803 | A | 8/1986 | Sawby | |
| 4,612,706 | A | 9/1986 | Yunes | |
| 4,802,279 | A | 2/1989 | Rowe | |
| 5,095,624 | A | 3/1992 | Ennis | |
| 5,111,581 | A | 5/1992 | Collins | |
| 5,131,149 | A | 7/1992 | Thompson et al. | |
| D336,602 | S | 6/1993 | Thompson et al. | |
| 5,325,588 | A * | 7/1994 | Rogers | 30/161 |
| 5,768,787 | A * | 6/1998 | Ireland | 30/294 |
| 5,802,722 | A | 9/1998 | Maxey et al. | |

(Continued)

FOREIGN PATENT DOCUMENTS

| | | |
|---|---|---|
| DE | 28765 | 1/1884 |

(Continued)

*Primary Examiner*—Timothy V. Eley
*Assistant Examiner*—Jason Prone
(74) *Attorney, Agent, or Firm*—Darby & Darby

(57) ABSTRACT

A folding knife includes a blade cavity defined by two liner plates into which a pivotal blade may reside. The blade, which is pivotally attached to liner plates at a pivot point, includes a tang having a recess that is parallel to the sides of the blade. A rod is pivotally secured to the blade within the recess. A spring is secured to either or both liner plates at one end and to the rod at the other end so that a pulling action is applied to the blade. The rod is attached to the blade with respect to the pivot point so that the action of the spring forces the blade into the blade cavity until the blade is rotated from the cavity past a critical point of angular displacement, after which the spring forces the blade to its fully open position.

The invention further includes a variety of locking arrangements which ensure that once the blade reaches its fully open position, the blade will remain there until the user desires to close it.

12 Claims, 17 Drawing Sheets

U.S. PATENT DOCUMENTS

| | | | | |
|---|---|---|---|---|
| 5,815,927 | A | 10/1998 | Collins | |
| 6,079,106 | A | 6/2000 | Vallotton | |
| 6,145,202 | A | 11/2000 | Onion | |
| 6,397,476 | B1 * | 6/2002 | Onion | 30/160 |
| 6,397,477 | B1 * | 6/2002 | Collins | 30/161 |
| 6,651,344 | B1 | 11/2003 | Cheng | |
| 6,684,510 | B1 * | 2/2004 | Collins | 30/161 |

FOREIGN PATENT DOCUMENTS

| | | |
|---|---|---|
| DE | 29469 | 6/1884 |
| FR | 493741 | 12/1918 |
| FR | 1069862 | 1/1953 |
| FR | 1171740 | 4/1957 |

* cited by examiner

SPRING ASSISTED FOLDING KNIFE

RELATED PATENT APPLICATIONS

This patent application claims the priority of U.S. provisional patent application No. 60/387,658, filed Jun. 10, 2002, entitled: "Spring Assisted Folding Knife", which is incorporated herein by reference.

BACKGROUND OF THE INVENTION a) Field of the Invention

This invention generally relates to folding knives, and more particularly, to folding knives that include an internal spring bias for assisting in the opening of the knife blade.

b) Description of the Prior Art

So-called spring-assisted foldable knives have been around at least since the early 1800's. These knives generally include a handle and a pivotally attached knife blade. A spring mechanism is attached between the handle and the knife blade so that the knife blade is biased to an open position. A locking mechanism is positioned within the handle portion and is designed to selectively engage the knife blade so that the blade may be held in a closed position, safely within the handle and against the action of the spring mechanism until it is needed. In use, an operator of the knife merely has to release the locking mechanism to cause the spring to force the blade to pivot to its open position. Once open, the locking mechanism typically engages the blade to hold it in its open position.

To close this prior art spring-assisted folding blade, the operator must first disengage the locking mechanism and then manually pivot the blade, against the action of the spring to its closed and again locked position. Some types of knives provide spring assist for both opening and closing the blade action.

U.S. Pat. Nos. 5,802,722 and 6,145,202 both of Onion both disclose a spring-assisted foldable knife assembly that includes a handle portion, a knife blade that is pivotally attached to the handle and operates within a knife plane. A torsion bar positioned within the handle and adjacent to the knife plane is attached between the handle and the knife blade. The torsion bar creates a "balanced" spring bias that applies either an opening force or a closing force depending on the angular position of the knife blade with respect to the handle.

In use, the operator of this type of knife pivots the blade towards its open position against the-closing action of the torsion bar. When the blade is pivoted past a point of equilibrium, the spring bias of the torsion bar begins to apply an-opening force to the blade and forces the blade to quickly pivot to its fully open position. To close the blade, the user first releases a locking mechanism and then forces the blade against the spring bias of the torsion bar, again until the blade passes the point of equilibrium, at which point the torsion bar pulls the blade to its closed position, safely within the handle.

SUMMARY OF THE INVENTION

A folding knife includes a blade cavity defined by two liner plates into which a pivotal blade may reside. The blade, which is pivotally attached to liner plates at a pivot point, includes a tang having a recess that is parallel to the sides of the blade. A rod is pivotally secured to the blade within the recess. A spring is secured to either or both liner plates at one end and to the rod at the other end so that a pulling action is applied to the blade. The rod is attached to the blade with respect to the pivot point so that the action of the spring forces the blade into the blade cavity until the blade is rotated from the cavity past a critical point of angular displacement, after which the spring forces the blade to its fully open position.

The invention further includes a variety of locking arrangements which ensure that once the blade reaches its fully open position, the blade will remain there until the user desires to close it.

DETAILED DESCRIPTION OF THE PREFERRED EMBODIMENTS

Figure 4:
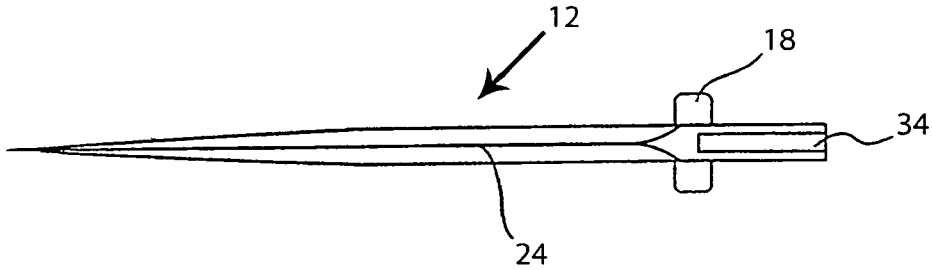
FIG. 4 is a bottom view of the knife blade of FIG. 3, showing details of a tang recess, according to the first embodiment of the invention.
Figure 5:
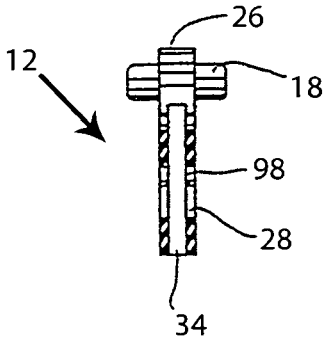
FIG. 5 is a sectional view of the knife blade of FIG. 3, taken along the lines 5—5, according to the first embodiment of the invention.

Referring to FIGS. 1 through 5, a knife 10, according to the invention, includes a knife blade 12, two parallel liner plates 14, two handle plates 16, a thumb pin 18, and a spring housing block 20. Blade 12 includes a tip 22, a cutting edge 24, a spine 26 (or an opposing second cutting edge, depending on the type of knife), a pivot opening 28, and a tang 30. Tang 30 includes a recess 34, as shown in FIGS. 4 and 5.

Figure 1:
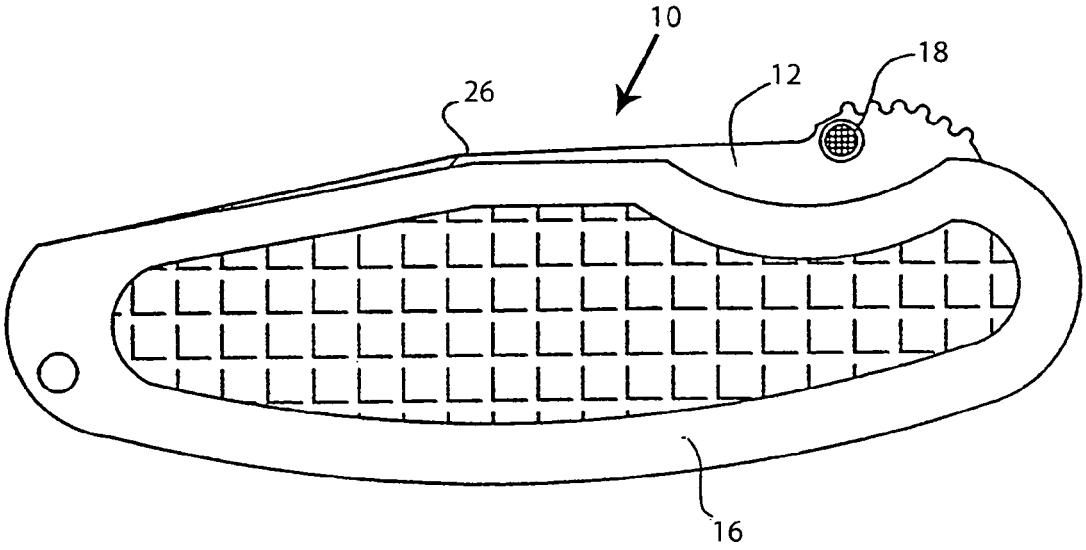
FIG. 1 is a side view of a folding knife, according to a first embodiment of the invention.

As shown in FIGS. 1–*7b*, blade 12 is pivotally attached between the two liner plates 14 by pivot pin 36, along pivot axis 38. Pivot pin 36 is sized and shaped to snugly fit within pivot opening 28 and is preferably a threaded fastener (e.g., a bolt) which may engage into aligned threaded openings formed within each respective liner plate 14, as is understood by those skilled in the art.

Figure 18:
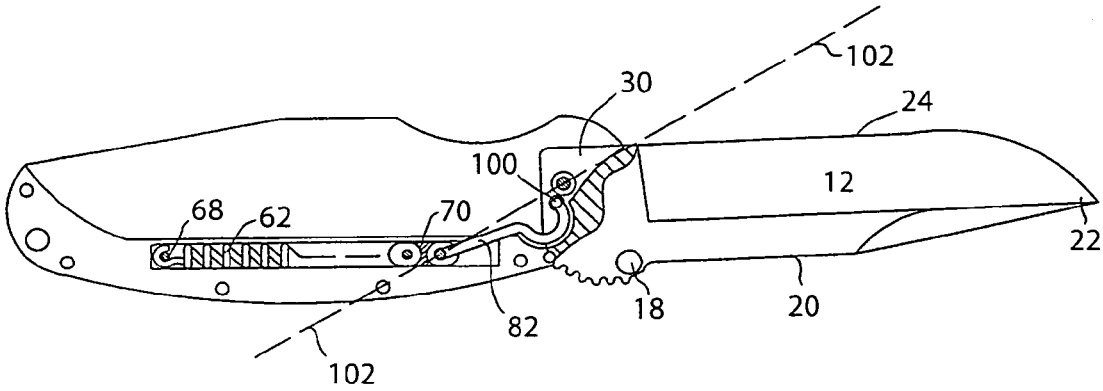
FIG. 18 is a concept side view of the knife of FIG. 16, wherein the blade is in a fully opened position, according to the first embodiment of the invention.
Figure 19:
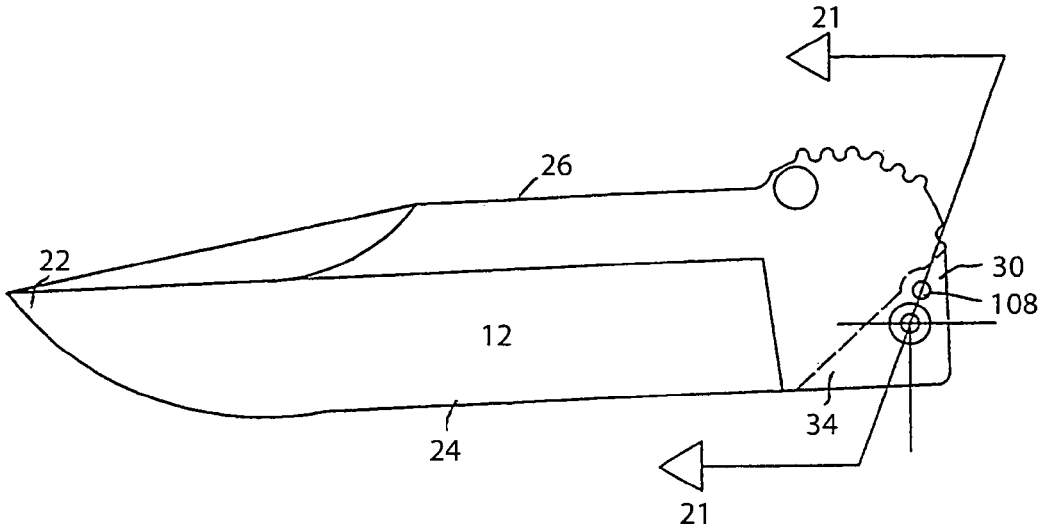
FIG. 19 is a side view of a blade according to a second embodiment of the invention, showing details of a split-pin pivoting assembly.

As shown in FIGS. 3, 4, 5, and 6, blade 12 is pivotal between a closed position, (FIG. 6), wherein blade 12 rests between liner plates 14 and cutting edge 24 is inaccessible and shielded, and a fully open position (FIG. 18), wherein blade tip 22 is positioned remote from liner plates 14 and cutting edge 24 is exposed and usable.

Referring now to FIGS. 2, 6, 8, 9, and 10, spring housing block 20 is positioned between liner plates 14, generally opposite spine 26 of blade 12 (when the blade is in its closed position within handle plates 16), and includes an upper surface 40, two side walls 42 (which make contact with an inside surface of each respective liner plate 14), a lower surface 44 (which is preferably shaped to follow the general contours of the handle plates 16 and liner plates 14), a rear surface 46 (which also is preferably shaped to follow the general contours of handle and liner plates 16, and 14, respectively), a front end surface 48, a longitudinally disposed spring recess 50, and several laterally directed bores 52. Bores 52 are sized and shaped to receive mechanical fasteners, such as bolts (not shown), which are used to secure liner plates 14 on either side of spring housing block 20 (abutting each respective side walls 42). As is generally understood by those skilled in the art, bores 52, and their respective receiving bolts (not shown) may be equally substituted with projecting pins which align with openings formed within each liner plate 14. These projecting pins may be integrally formed with the spring housing block 20.

Figure 8:
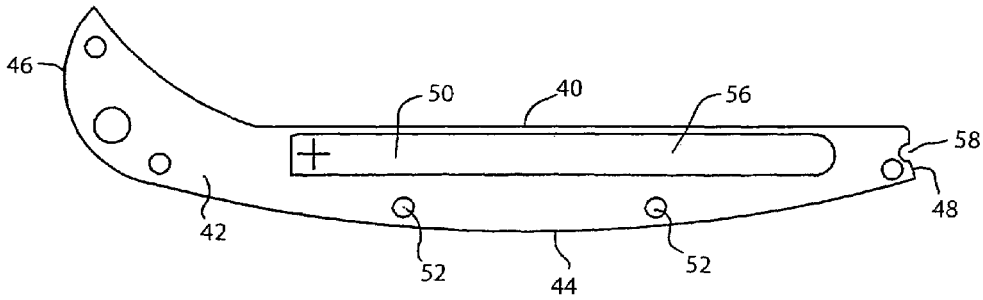
FIG. 8 is a side view of a spring housing block, according to the first embodiment of the invention.
Figure 9:
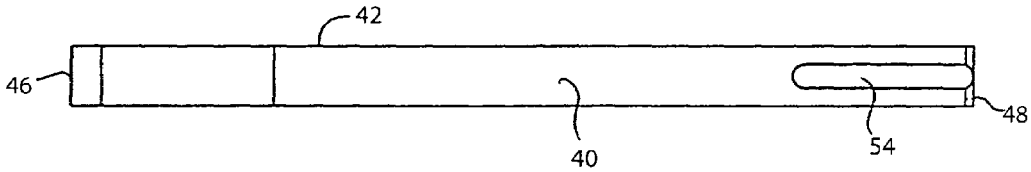
FIG. 9 is a top view of the spring housing block of FIG. 8, showing details of rod-access slot, according to the first embodiment of the invention.
Figure 10:
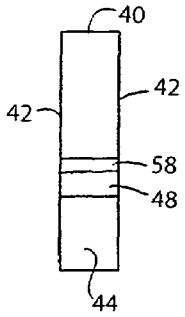
FIG. 10 is a front view of the spring housing block, according to the first embodiment of the invention.

Positioned on upper surface 40 and adjacent to front end surface 48 is a rod-access slot 54 which provides selective access to within spring recess 50, as described below. Spring recess 50 preferably includes at least an open side window 56 within one side wall 42, as shown in FIG. 8. Side window 56 and spring recess 50 are sized and shaped to accommodate a spring 62. Front end surface 48 further includes a pin-recess 58 which is sized and shaped to receive a stop-pin 60 (described below, and shown in FIG. 2).

Figure 6:
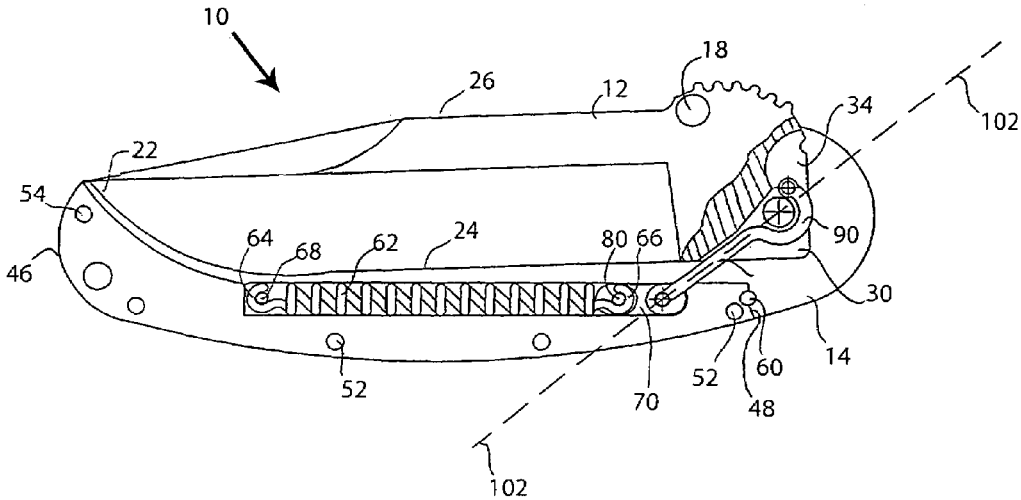
FIG. 6 is a side view of the folding knife similar to the one shown in FIG. 1, shown without a handle plate or a liner plate, revealing details of a spring-assisted opening mechanism, according to the first embodiment of the invention.

Referring to FIG. 6, spring 62 is positioned within spring recess 50 and includes rear-hook (or loop) 64, and a front hook (or loop) 66. A lateral anchor pin 68 is positioned at a rear end of spring recess 50 and is secured to at least one liner plate 14. Lateral anchor pin 68 is sized and shaped to receive rear-,hook 64 of spring 62 and effectively anchor the rear portion of spring 62 to the body of the knife.

Figure 11:
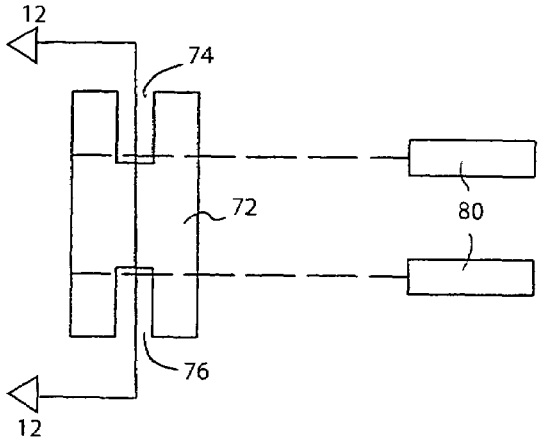
FIG. 11 is a top view of a linkage element, showing details of pivot pins, according to the first embodiment of the invention.
Figure 12:
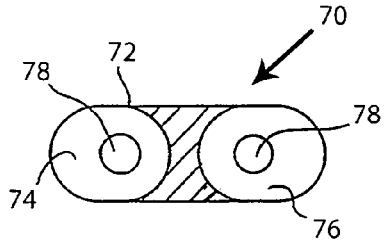
FIG. 12 is a sectional view of the linkage element of FIG. 11, taken along the lines 12—12, showing details of front and rear vertical slots, according to the first embodiment of the invention.
Figure 13:
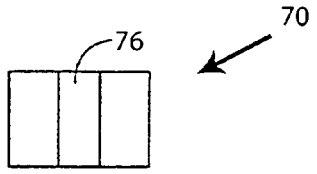
FIG. 13 is a front view of the linkage element of FIG. 12, showing details of the front vertical slot, according to the invention.
Figure 14:
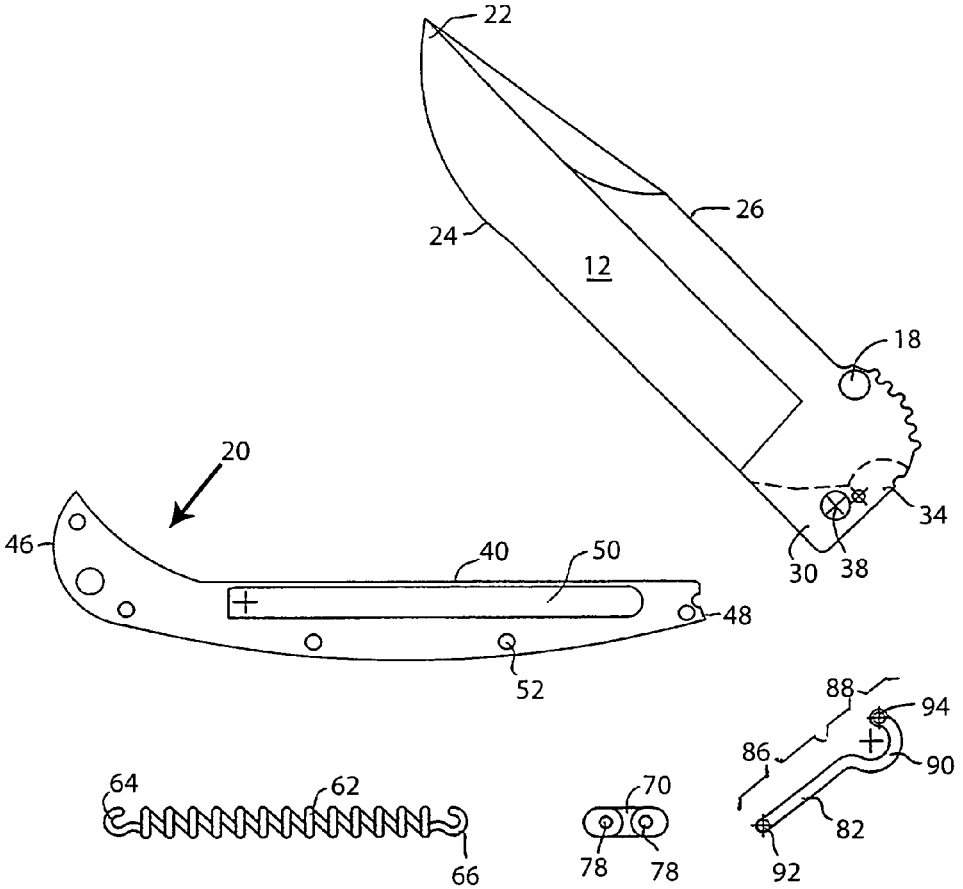
FIG. 14 is an assembly view of the spring assisted mechanism, showing details of the blade, the rod, the spring housing block, the linkage, and a spring, according to the first embodiment of the invention.

Referring to FIGS. 6, 11, 12, 13, and 15, positioned within spring recess 50, adjacent to the front end surface 48 is a linkage 70, which is generally block-rectangular in shape (resembling a link of a bicycle chain) and includes a bearing surface 72. Linkage 70 is sized and shaped to snugly fit and slide (longitudinally) within spring recess 50. Linkage 70 includes a front vertical slot 76 and a rear vertical slot 74, and two lateral bores 78, which are sized and shaped to receive two lateral pins 80, respectively, as shown in FIG. 11. Linkage 70, is preferably wide enough to extend within the plane of each respective liner plate 14 so that the strong liner plate 14 can function as a guide to linkage 70 as linkage 70 moves. In such instance, liner plates 14 much include an appropriate slot which is sized and shaped to accommodate the linkage 70.

Figure 15:
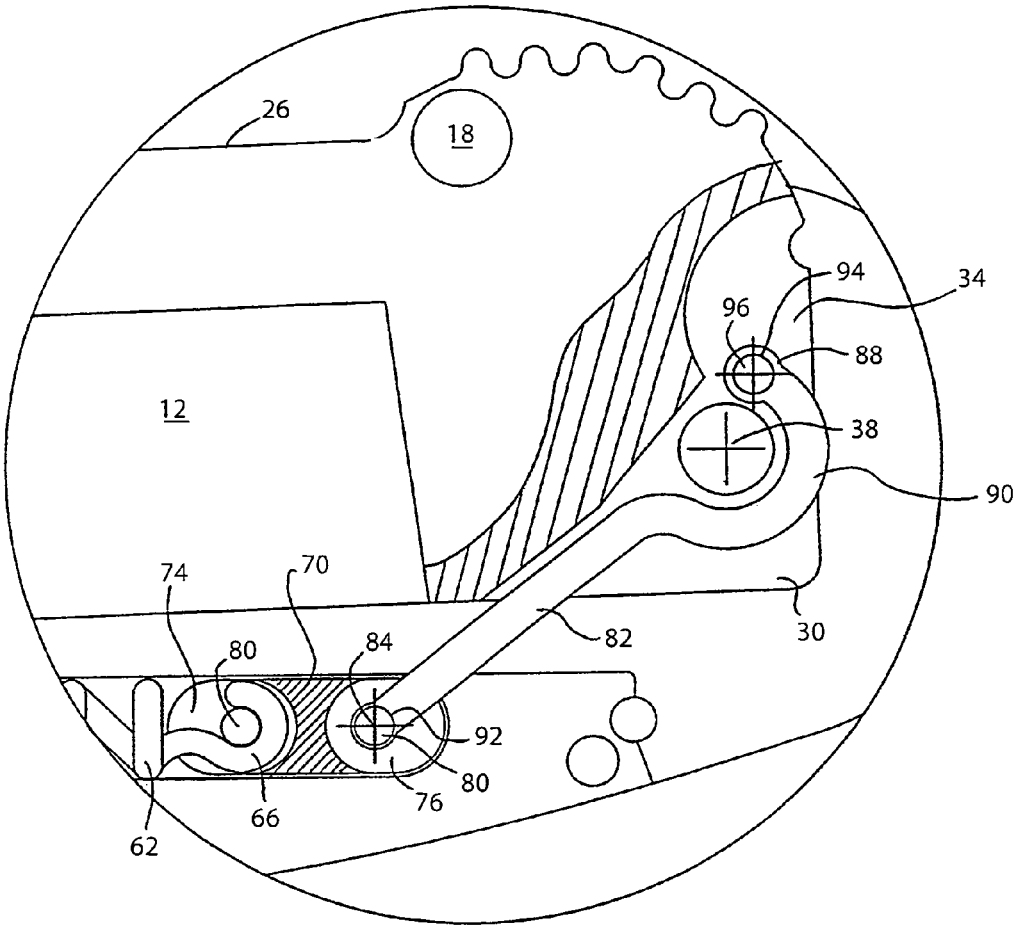
FIG. 15 is a partial enlarged sectional side view of the knife, according to the first embodiment of the invention, showing details of the rod attached to the tang of the blade within the tang recess, the linkage, and the spring located within the spring housing block.

Front hook 66 of spring 62 is positioned within rear vertical slot 74 of linkage 70 and secured therein by lateral pin 80, as shown in FIGS. 6 and 15 so that movement of linkage 70 is influenced by the bias of spring 62. Spring 62 is preferably a coil type spring that applies a pulling force to linkage 70 so that linkage 70 is pulled rearwardly at all times, during the opening and closing of blade 12 from knife 10.

As shown in FIGS. 2, 6, 14, and 15, a connecting rod (or linkage) 82 connects tang 30 of blade 12 to linkage 70. According to one preferred embodiment, rod 82 is shaped similar to a little question mark (like this one—?—but bigger), including a straight lower end 86, an upper end 88, and a curve 90 formed near upper end 88. Rod 82 includes a lower pin-receiving bore 92 at lower end 86, and an upper pin-receiving bore 94 at upper end 88. As shown in FIG. 15, lower end 86 of rod 82 is slidably positioned within rod-access slot 54 and pivotally attached to linkage 70 at pivot point 84. Rod 82 is attached to linkage 70 within front vertical slot 76 by pin 80. Upper end 88 of rod 82 is pivotally attached to tang 30 of blade 12 within recess 34, using pin 96. Pin 96 is preferably attached to tang 30 within bores 98 of blade 12 (rod 82 pivots about rod-pivot axis 100 (see FIG. 2). Rod 82 is preferably made from a strong rigid material (such as spring steel or tempered steel), and is sized to fit within recess 34 without friction or interference.

Figure 2:
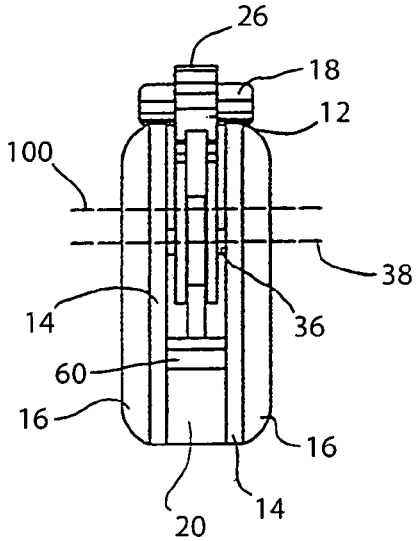
FIG. 2 is a front view of the folding knife of FIG. 1, according to the first embodiment of the invention.
Figure 3:
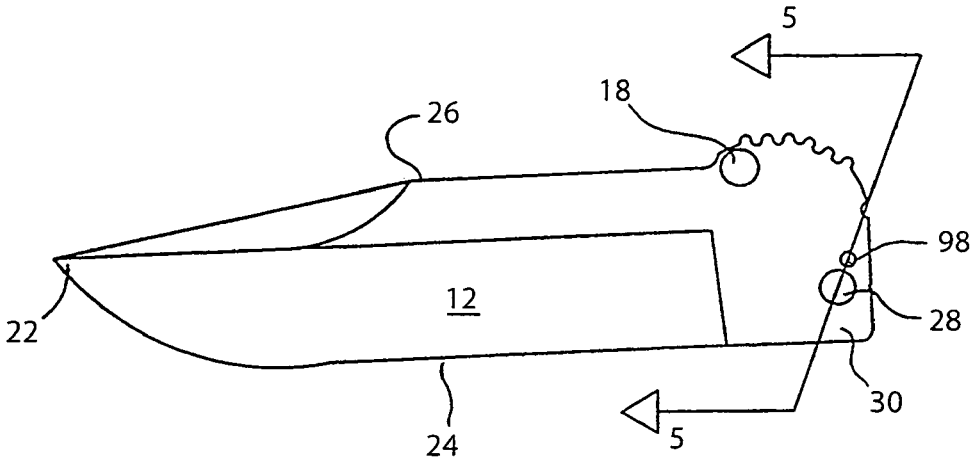
FIG. 3 is a side view of a knife blade, according to the first embodiment of the invention.

The exact shape of rod 82, its length, its exact connection point at tang 30 and the length and strength of spring 62 are critical parameters which will dictate the performance and operation of the opening and closing process of blade 12 from knife 10. To aid in explaining these critical parameters, a line of equilibrium 102 is provided (see FIGS. 6 and 16–18), and is defined herein as the line intersecting both pivot axis 38 and pivot point 84 (where rod 82 pivotally connects with linkage 70). An important aspect of the present invention is that when blade 12 is in its fully closed position (as shown in FIGS. 1, 2, and 6), rod-pivot axis 100 is positioned above pin 36 and behind (i.e., rear of) line of equilibrium 102 (preferably around a 1 o'clock position where the "clock" is centered about pivot axis 38). In this arrangement, the pulling action of spring 62 applies a rearwardly directed spring bias to linkage 70, which, in turn, causes rod 82 to force blade 12 to rotate counterclockwise towards its fully closed position (as shown in FIG. 6). The end result is that the blade of the present knife will be held in its fully closed position by spring 62, until a user starts to open the blade.

Figure 16:
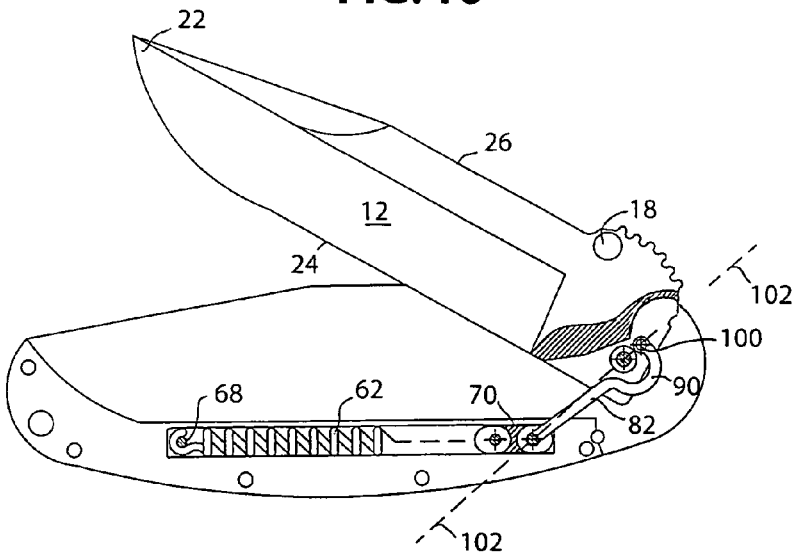
FIG. 16 is a concept side view of the knife of FIG. 6 (shown without a liner plate and a housing plate to reveal details of the spring-assisted opening mechanism), shown with the blade in a partially opened position wherein the rod is located on the line of equilibrium, according the first embodiment of the invention.
Figure 17:
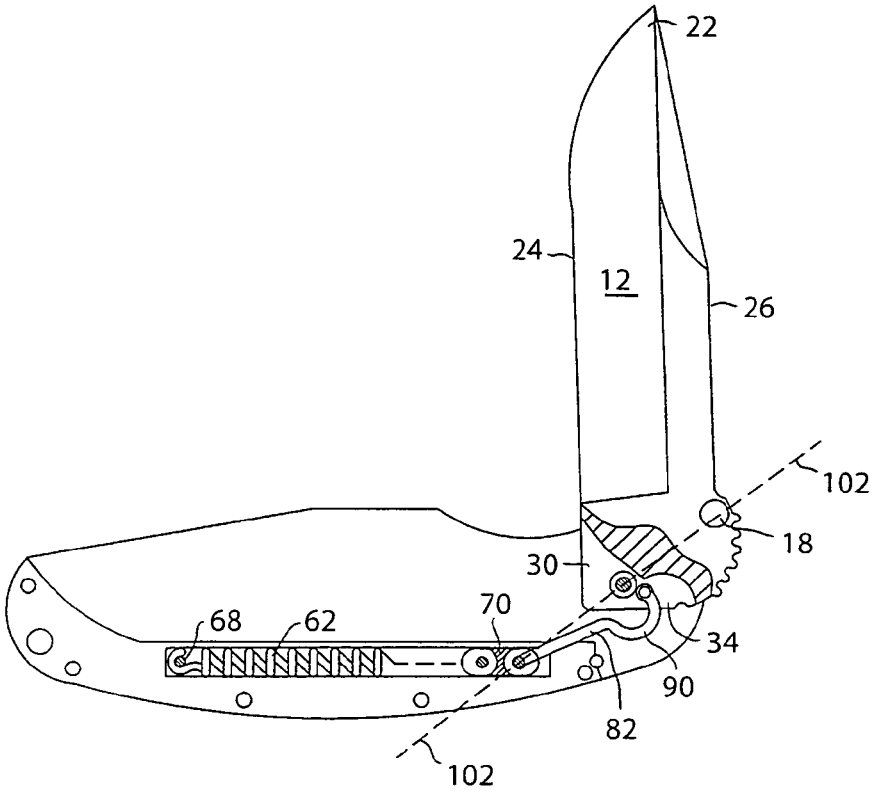
FIG. 17 is a concept side view of the knife of FIG. 16, wherein the blade is opened to a further position wherein rod is located beyond the line of equilibrium, according to the first embodiment of the invention.

Referring to FIGS. 6, 16, 17, and 18, as blade 12 is manually rotated about pivot axis 38 (against the action of spring 62, described above), rod-pivot axis 100 will also rotate about pivot axis 38, advancing towards line of equilibrium 102, until it resides on line of equilibrium 102, as shown in FIG. 16. This is a "turning point", after which spring 62 will no long cause blade 12—to rotate counter-clockwise, but will instead, cause blade 12 to rotate clockwise (as shown in FIG. 17), until it locks at its fully open position, (shown in FIGS. 18). As blade 12 rotates about pivot axis 38, linkage 70 will slide within rod-access slot 54 and spring recess 50 as necessary to accommodate movement of rod 82 (this is illustrated in FIGS. 6, 16, 17 and 18).

In use, an operator holds the present knife 10 in one hand, and uses his thumb and thumb pin 18 to rotate blade 12 from its fully closed position within protective liner plates 14 against the relatively mild closing action created by spring 62. The force of the closing action will diminish as blade 12 is opened further until the "turning point" at which the rod-pivot axis 100 passes in front of the line of equilibrium 102. Once the blade reaches the turning point, any further clockwise of blade 12 will cause spring 62 to create a bias that encourages blade 12 to quickly rotate to the blade's fully open position (shown in FIG. 18).

Once blade 12 reaches the fully open position, any appropriate locking mechanism can be used to hold the blade at the fully open position, as understood by those skilled in the art. Although many different locking mechanisms can be employed without departing from the gist of the invention, a liner-lock mechanism is preferred, as described in greater detail below. The spring action and the use of a "line of equilibrium" attachment allows single-handed operation to open the blade, and, as described below, to further close the blade.

To close blade 12, the user first disengages the blade locking mechanism (which ever type is used), and, using the forefinger of the hand holding the knife (or any appropriate surface, or the user's other hand) rotates blade 12 counter-clockwise about pivot axis 38 and against the relatively strong opening bias of spring 62 until rod-pivot axis 100 again crosses the line of equilibrium 102, at which point, the pulling force of spring 62 will be redirected so that blade 12 is forced back to its fully closed position within liner plates 14 and handle plates 16.

An important feature of the present invention is that blade 12 is connected to spring 62 by rod 82 wherein both rod and spring are positioned and operate within the same plane as blade 12. Although prior art spring-assisted knives of the type that provide a line of equilibrium (wherein a spring bias forces a blade both closed and open depending on the angular displacement of the blade with respect to the knife) use a rod connecting the spring with the tang of the blade, the rod is offset with respect to the plane of the blade. The present knife includes recess (or slot) 34 which allows rod 82 to be attached to blade 12 within the plane of the blade 12. Some early knife designs of the prior art use a spring to open the blade wherein the spring and the attachment to the blade is positioned within the plane of the blade. In these prior art knives, however, there is no line of equilibrium used so the spring bias never causes the blade to rotate to its closed position.

In contrast, the present knife creates a slot within the tang 30 of blade 12 towards tip 22 past the line of equilibrium (which is generally past the pivot axis 38).

The slot or recess 34 is preferably formed by machining into tang 30 of blade 12 during the manufacture of blade 12, but can be formed using any other appropriate method, as understood by those skilled in the art.

Rod 82 is preferably made from a strong rigid material such as tempered or spring steel.

Spring housing block 20 is preferably made injection molding a strong (possibly fiber reinforced) plastic, but also may be made by machining an appropriate metal, such as steel or aluminum. Spring housing block 20 is shaped according to the particular desired shape and size of knife 10. Spring recess may be either straight (as shown in FIG. 16, for example) or curved (not shown) depending on the particular shape and size of knife 10.

Liner plates 14 are preferably made from tempered steel plate, as well as blade 12, as is understood-by those skilled in the art.

Blade 12 may be shaped appropriately and may include any type and shape of cutting edge, including a jagged edge and a double cutting edge.

Linkage 70 is preferably made from a strong material, such as tempered steel or reinforced plastic.

Spring 62 is preferably a coil-type tension spring that is sized and shaped to fit within spring recess 50 of spring housing block 20 and includes two integrally formed end hooks, as described above. The strength of spring 62 depends on the size, weight, and materials used for blade 12, linkage 70 and rod 82, as well as the relative locations of pivot axis 38 and rod-pivot axis 100, and the size and shape of linkage 70. Depending on the handle design and size, a different arrangement of spring may be necessary, including the use of two or more tension type springs, or an arrangement of other types of springs (including torsion members).

Figure 20:
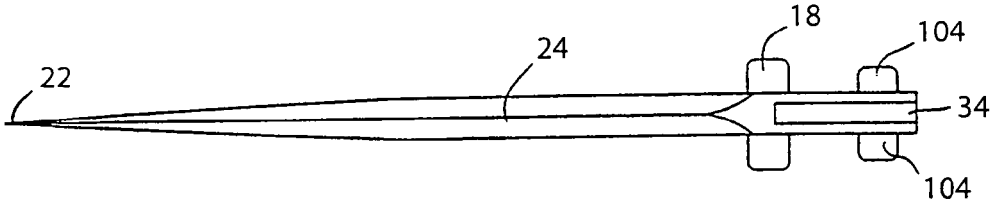
FIG. 20 is a bottom view of the blade of FIG. 19, showing details of a split-pin pivoting assembly, according to a second embodiment of the invention.
Figure 21:
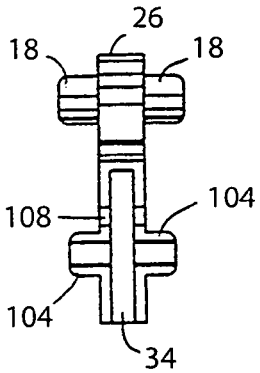
FIG. 21 is a rear sectional view of the blade of FIG. 19, taken along the line 19—19, showing details of a split-pin pivoting assembly, according to a second embodiment of the invention.
Figure 22:
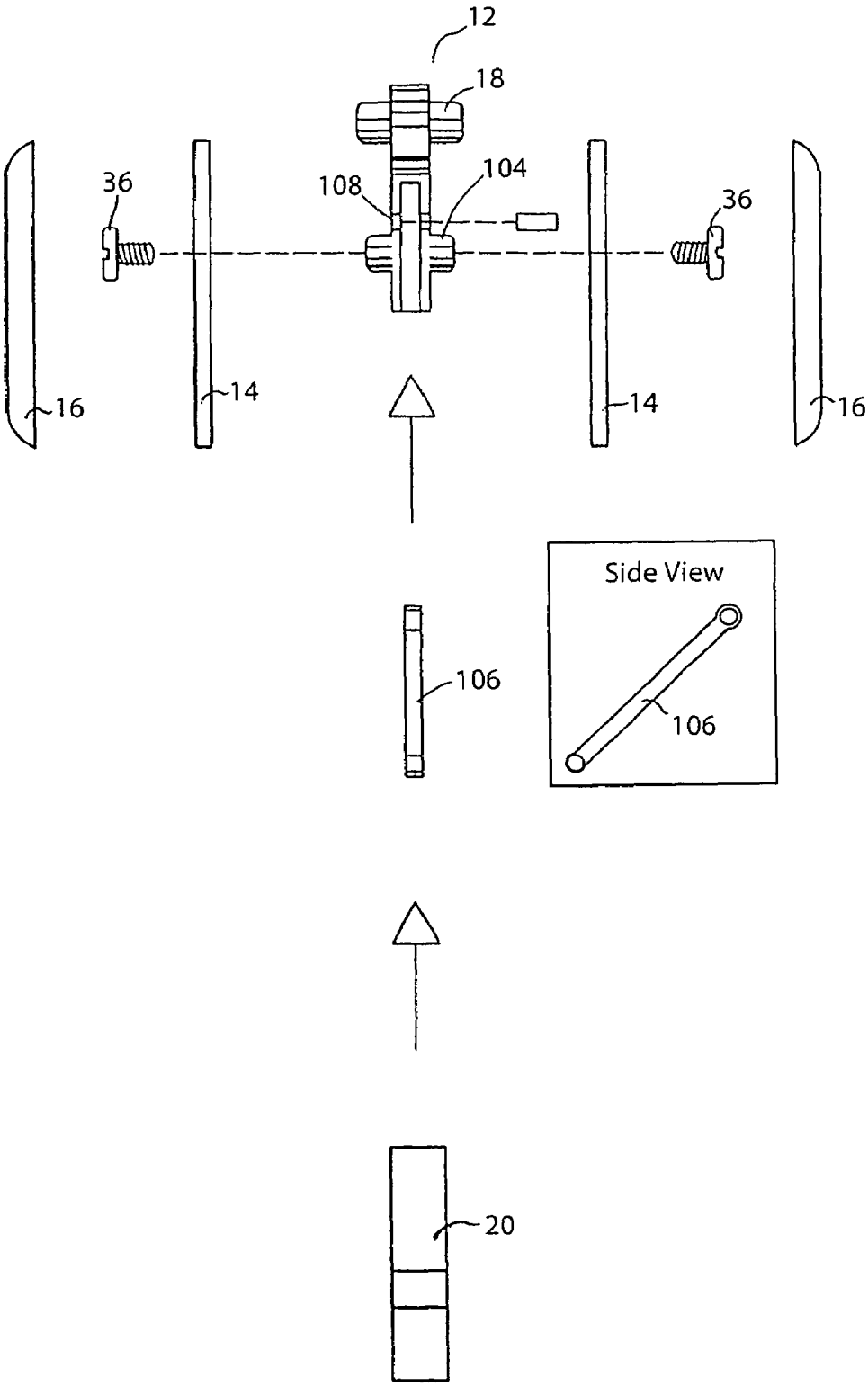
FIG. 22 is an assembly view of a knife, according to the second embodiment of the invention, showing details of the blade of FIG. 19, liner plates, handle plates, a straight rod, a spring housing block, securing bolts, and a pivot pin.
Figure 23:
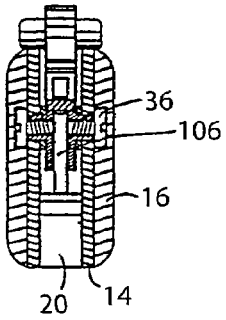
FIG. 23 is a sectional view of the knife of FIG. 25, taken along the lines 23—23, showing details of the blade pivotally attached to liner plates, housing plates, using securing bolts, according to the second embodiment of the invention.
Figure 24:
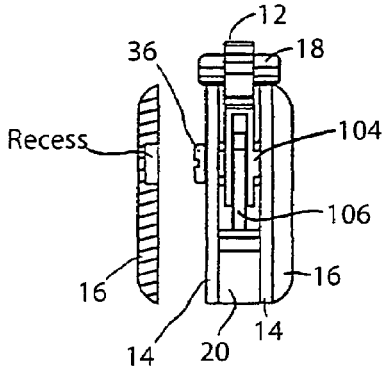
FIG. 24 is an end view of the knife of FIG. 23, showing one handle plate in section to reveal a recess formed therein sized and positioned to accommodate the head of a securing bolt, according to the second embodiment of the invention.
Figure 25:
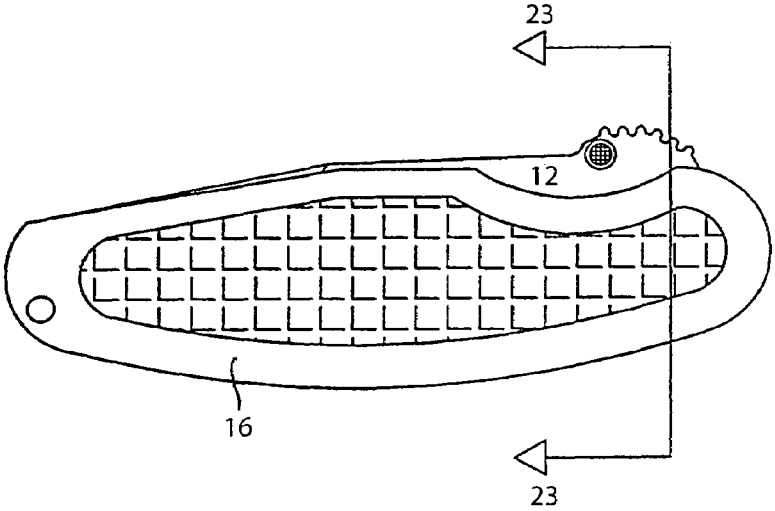
FIG. 25 is a side view of the knife, according to the second embodiment of the invention.
Figure 26:
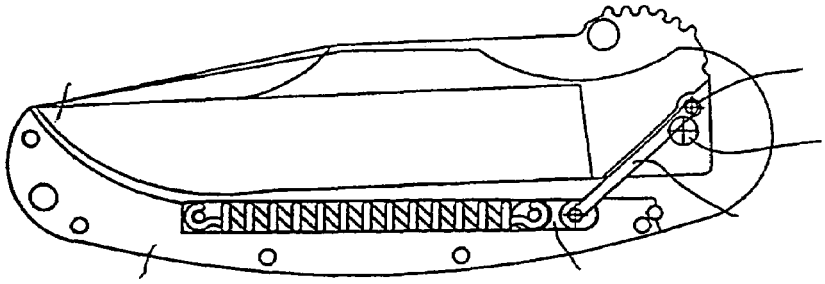
FIG. 26 is a concept view of the knife of Fig, 25, shown without a liner plate or a handle plate to reveal details of the spring assisted opening mechanism, according to the second embodiment of the invention.
Figure 27:
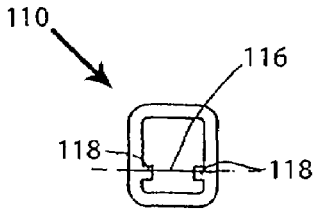
FIG. 27 is a rear view of a clip, according to a third embodiment of the invention.
Figure 28:
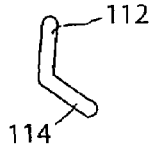
FIG. 28 is a side view of the clip of FIG. 27, according to the third embodiment of the invention.
Figure 29:
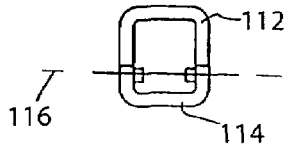
FIG. 29 is a front view of the clip of FIG. 27, according to the third embodiment of the invention.

As described above, and shown in the accompanying figures, blade 12 is preferably pivotally attached to and positioned between liner plates 14. An appropriate bolt or pivot pin 36 is preferably used to pivotally secure knife blade 12 to liner plates 14. In such instance, rod 82 must include curve 90 to accommodate pin (or bolt) 36 and position the effective attaching point of spring 62 to blade 12 rear of the line of equilibrium 102 (as shown in FIG. 15) when blade 12 is at or near its closing position. According to another embodiment of the invention, referring to FIGS. 19–26, blade 12 includes opposing integrally formed pin-halves 104, each projecting outwardly from blade 12, as shown in FIGS. 20 and 21. Neither pin half 104 extends into recess 34 so that rod 82 may move freely within recess 34 between pin halves 104. With this arrangement, a straight rod 106 (similar to rod 82, described above, but without curve 90) connects blade 12 and linkage 70 at a connection point 108. The knife shown in FIGS. 19–26 operates in a similar manner to the knife described above, and shown in FIG. 6. When blade 12 of the knife shown in FIGS. 19–26 is in its fully closed position and connection point 108 is positioned behind (closer to the rear portion of the knife) the line of equilibrium 102, spring 62 applies a pulling force on blade 12 so that blade 12 is drawn into its closed position and held there by the bias of spring 62 until it is needed. As in the previously described embodiment (see FIG. 6), when a user pivots blade 12 from its rest and fully closed position, eventually point of connection 108 will cross over the line of equilibrium 102 and spring 62 will then bias blade 12 to angularly displace clockwise. The end result is that once the user moves blade 12 past a certain point (using thumb pin 18, for example), the blade will automatically and relatively quickly pivot to its fully open position. The exact location of the line of equilibrium in any embodiment of this invention will dictate how far the user must open the blade against the action of spring 62 until spring 62 will force the blade open.

With this arrangement, recess 34 effectively extends within tang 30 past pivot axis 38 without obstruction so that rod 82 does not need to include curve 90 and may be made straight (also, a flexible cable can be used in this "split-pin" arrangement). It should be noted, however, that with this split-pin arrangement, additional reinforcement of and/or securement between liner plates may be necessary to ensure that blade 12 is suitably secured to liner plates 14. This may require that each pin section be welded to or otherwise integrally formed with blade 12, as shown in FIGS. 19–26.

Figure 7A:
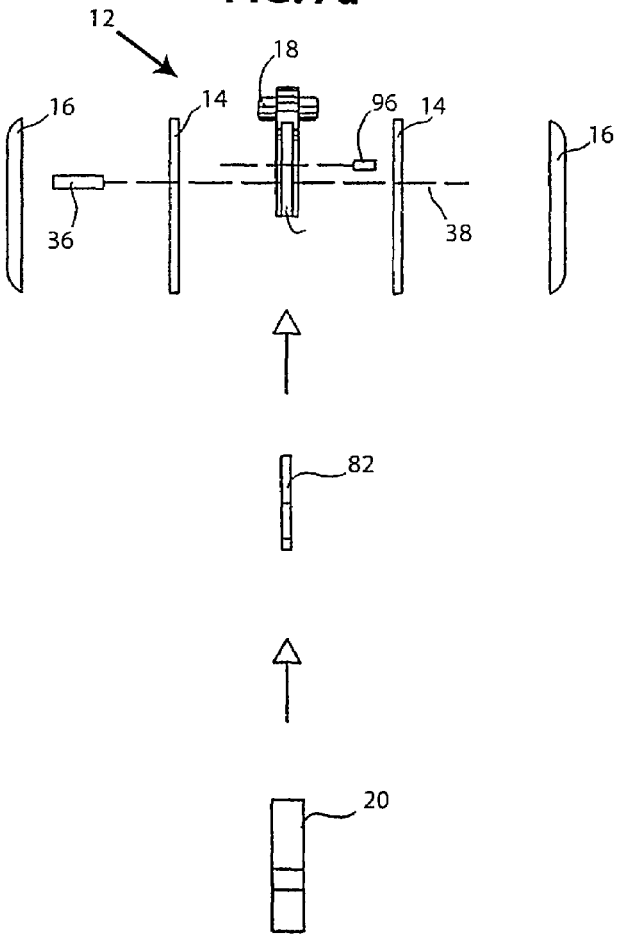
FIG. 7*a* is a front assembly view of the knife, according to the first embodiment of the invention, showing details of the blade, its tang recess, liner plates, and handle plates, and a rod.
Figure 7B:
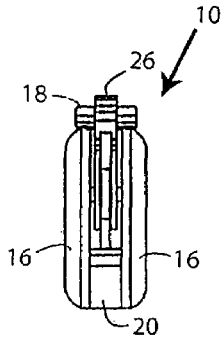
FIG. 7*b* is a front view of the knife, according to the first embodiment of the invention, showing an assembled knife.
Figure 36:
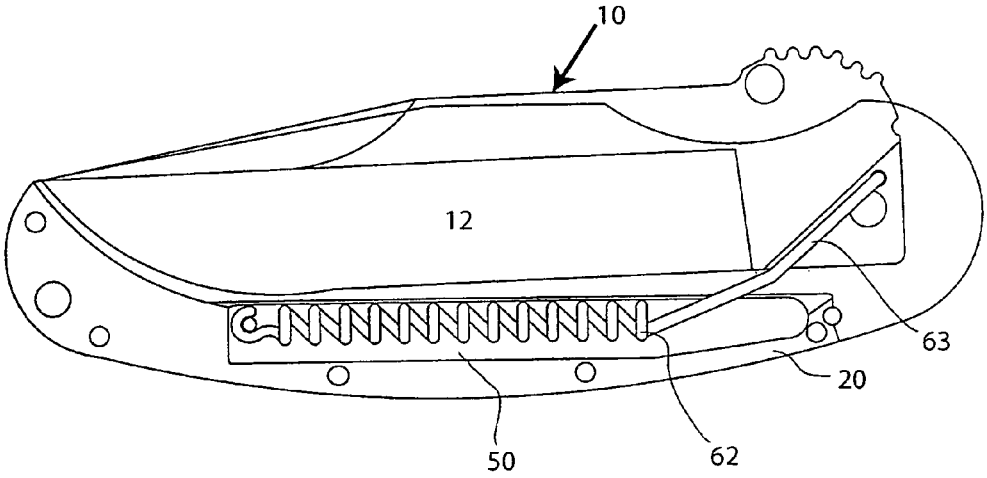
FIG. 36 is a side view of a knife, (shown without a liner plate or a handle plate) showing details of a spring assisted opening mechanism, according to a fourth embodiment of the invention.

According to yet another embodiment of the invention, spring 62 is connected directly to tang 30 of blade 12 using either the split-pin arrangement (wherein spring 62 may include a relatively straight connection portion 63, as shown in FIG. 36. If the full-pin version is used (as in FIGS. 6, 7*a*, and 7*b*), connection portion 63 may also include a curved portion (similar to curve 90—see FIG. 6) to accommodate the full pivot pin 36. With this arrangement, linkage 70 and rod 82 may be eliminated, and the cost of manufacture thereby reduced owing to the simple construction requiring fewer parts.

In either case, spring 62, linkage 70, rod 82 (or 104) and the point where the rod connects with blade 12 as well as the relative location of pivot axis 38 are preferably designed so that blade 12 is forced into its fully closed position sufficiently to prevent, or at least discourage accidental opening of blade 12, should knife 10 be thrown or dropped. Referring to FIGS. 27–35, to help ensure that blade 12 does not accidentally open either while the knife 10 is being stored, shipped, or worn by a user, a clip 110 is provided. Clip 110 includes a first U-shaped hanging loop 112, a second U-shaped hanging loop 114 connected to the first loop 112 at a connecting axis 116, and two opposing pivot pins 118 positioned along connecting axis 116 and inwardly directed. Clip 110 is preferably made from a strong material such as steel or a very strong plastic. Clip 110 is pivotally secured to knife 10 by at an appropriate opening 120 positioning each pin half 118 in opening 120 on each respective side of knife 10, as shown in FIGS. 30–35. Clip 110 is preferably resilient and therefore allows a slight give in its shape so that pin halves 118 can be separated from each other sufficiently to allow knife 10 to fit therebetween. Once pin halves 118 are aligned with opening 120, the resiliency of the material used to make clip 110 will cause the clip to return to its original shape and thereby cause pin halves 118 to "snap" into opening 120 so that clip 110 becomes pivotally attached to knife 10.

Figure 30:
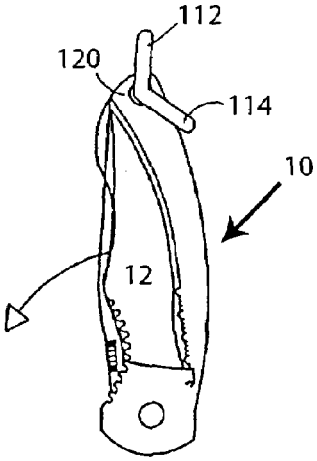
FIG. 30 is a side view of the clip of FIG. 27, shown pivotally attached to a knife and positioned in an unlocked position (the blade of the knife is revealed to explain the operation of the clip), according to the third embodiment of the invention.
Figure 31:
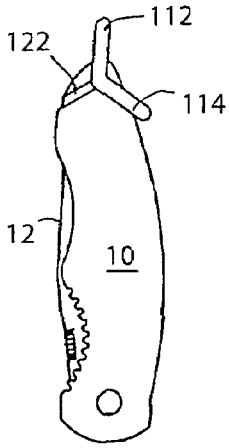
FIG. 31 is a side view of the clip of FIG. 27, shown pivotally attached to a knife and positioned in an unlocked position, according to the third embodiment of the invention.
Figure 32:
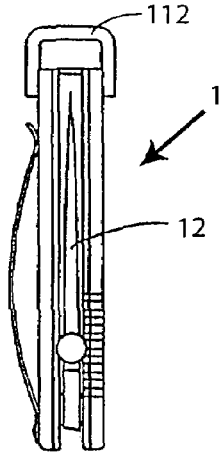
FIG. 32 is a top view of the knife of FIG. 31, showing a blade located within a blade cavity and details of a loop of the clip in an unlocked position, according to the third embodiment of the invention.
Figure 33:
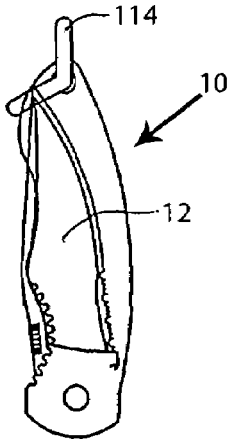
FIG. 33 is a side view of the clip of FIG. 27, shown pivotally attached to a knife and positioned in a safety position (the blade of the knife is revealed to explain the operation of the clip), according to the third embodiment of the invention.
Figure 34:
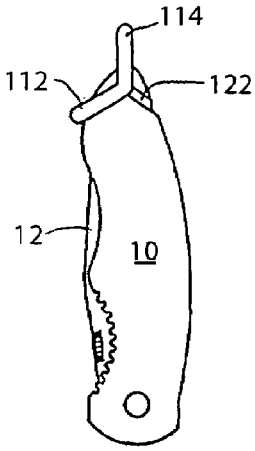
FIG. 34 is a side view of the clip of FIG. 27, shown pivotally attached to a knife and positioned in a safety position, according to the third embodiment of the invention.
Figure 35:
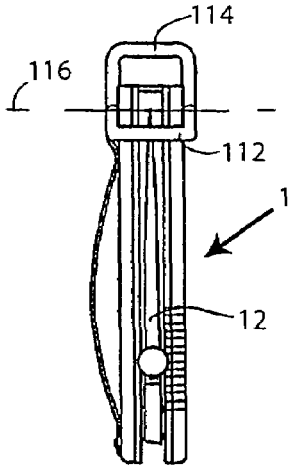
FIG. 35 is a top view of the knife of FIG. 31, showing a blade located within a blade cavity and details of a loop of the clip in a safety position preventing the removal of the blade from the blade cavity, according to the third embodiment of the invention.

Clip 110 is pivotal between an unlocked position, shown in FIGS. 30–32, and a safety position, shown in FIGS. 33–35. Loop 112 is preferably angularly offset from loop 114 by about 130 arc degrees (although any offset angle may be used depending on the particular shape of knife 10 and blade 12). When clip 110 is positioned in its unlocked position, as shown in FIG. 30, loop 112 is arranged in a general vertical position (away from knife 10) and is accessible to be used to secure knife 10 to a hanging tether (not shown). In this unlocked position, loop 114 resides against the back side of knife 10 (opposite the blade access side), as shown in FIGS. 30–32. In the unlocked position, clip 110 does not interfere with the pivotal movement of blade 12 and blade 12 may be opened without rotating clip 110.

When clip 110 is moved to its safety position, shown in FIGS. 33–35, loop 114 is now positioned generally vertical (away from knife 10) and may therefore be used to secure knife 10 to a hanging tether (not shown). Loop 112 is positioned across the path of blade 12 so that blade 12 is prevented from pivoting from its fully closed position to an open position. The weight of knife 10 hung from tether (not shown) encourages clip 110 to maintain its safety position. To further encourage clip 110 to hold its position (either unlocked or safety), appropriate grooves 122 are provided within knife handle plate 16, as shown in FIGS. 31 and 34. Each groove 122 is sized and positioned to snugly receive either loop 112 or loop 114 (depending on the position of clip 110). As clip 10 rotates about opening 120, loop 112 or loop 114 will eventually align with groove 122. The resiliency of clip 110 will cause loop 112, 114 to snap into groove 122 when in alignment. Groove 122 functions somewhat as a position stop for clip 110.

Locking Mechanisms

Figure 37:
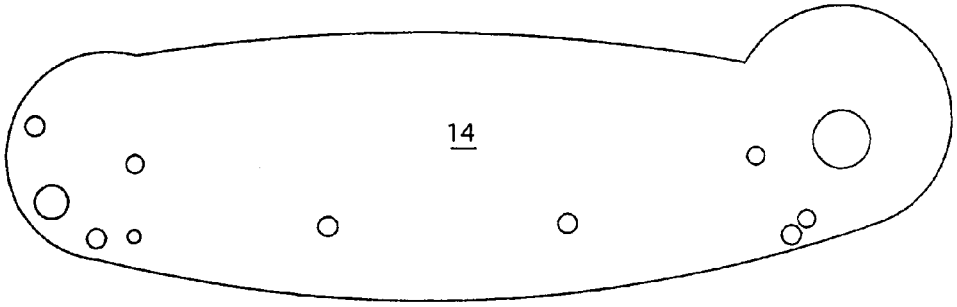
FIG. 37 is a side view of a liner plate, according to the invention.
Figure 38:
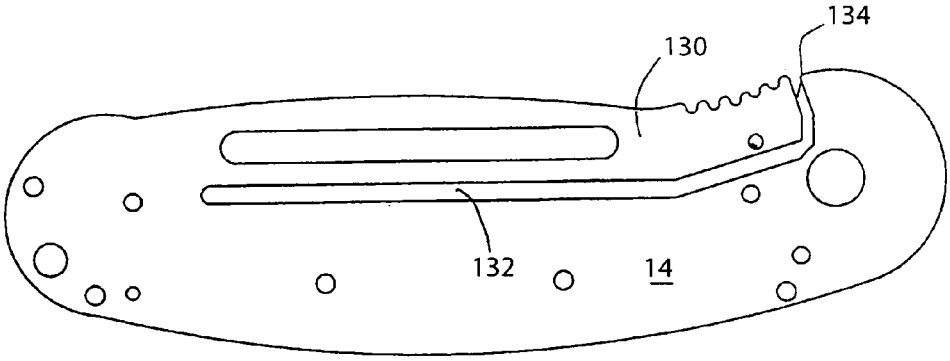
FIG. 38 is a side view of a locking liner plate, according to the invention, showing details of a locking tab.
Figure 39:
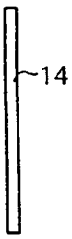
FIG. 39 is an end view of the liner plate of FIG. 38, showing the thickness of the liner plates, according to the invention.

The present invention may use any of a variety of locking systems known in t e prior art, such as a liner-type locking system. Referring to FIGS. 37, 38 and 39, handle plates 16 are shown having an integrally formed liner-lock tab 130 in one handle plate 16. Liner-lock tab 130 is formed in one handle plate 16 by cutting shaped slot 132, thereby defining a locking edge 134. As is understood by those skilled in the art, tab 130 is bent so that locking edge 134 becomes spring biased inwardly against knife blade 12 (towards the opposing liner plate 14). In normal operation, when the blade of a knife is opened, locking edge 134 of liner plate 14 moves into a locking arrangement abutting tightly against the back edge of the blade. However, a concern arises in the present invention since tang 30 of the present knife 10 is slotted (forming recess 34). Locking edge 134 is thin enough to inadvertently slip into recess 134 and thereby fail to hold blade 12 in its fully open position.

Figure 40:
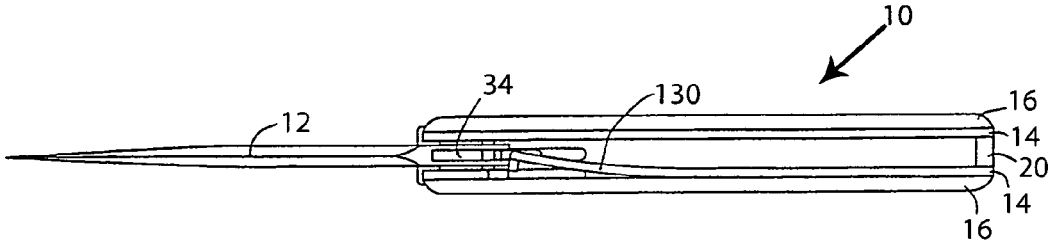
FIG. 40 is a top view of a knife, showing a blade in an open position, a locking liner plate with its locking tab in a locked position against the tang of the blade, according to the invention.
Figure 41:
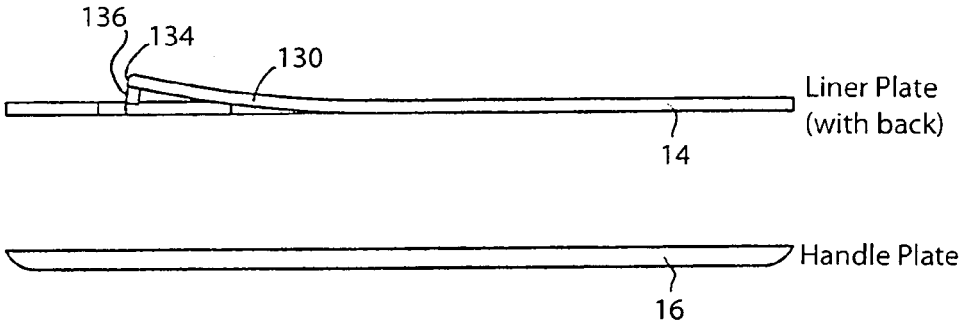
FIG. 41 is an assembly top view of the locking liner plate and a handle plate, according to the invention.
Figure 42:
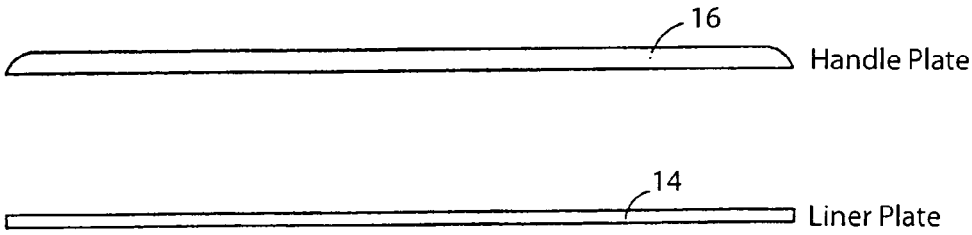
FIG. 42 is an assembly top view of a non-locking liner plate and a handle plate, according to the invention.
Figure 43:
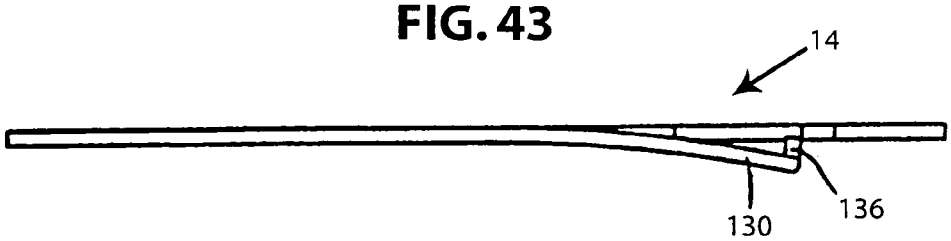
FIG. 43 is top view of the locking liner plate, according to the invention, showing details of an angle extension.
Figure 44:
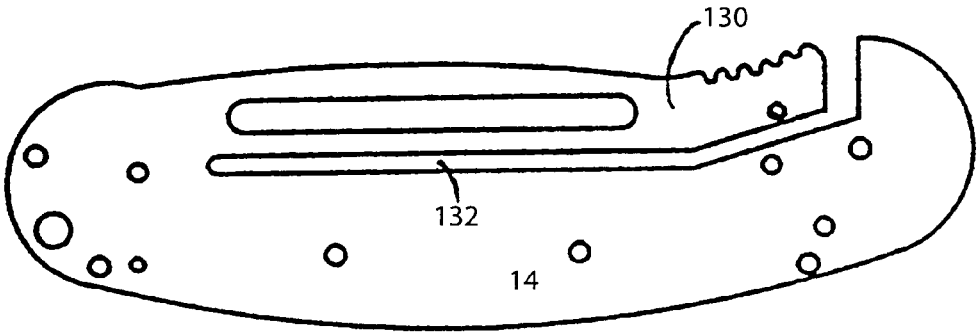
FIG. 44 is a side view of the locking liner plate of FIG. 43, according to the invention.
Figure 45:
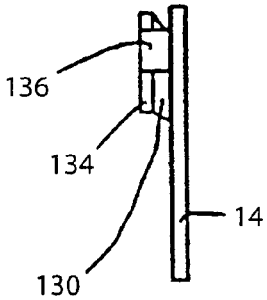
FIG. 45 is a front view of the locking liner plate of FIG. 44, showing details of the angle extension, according to the invention.
Figure 46:
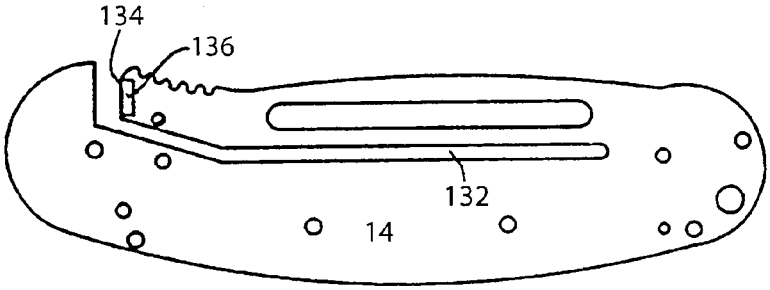
FIG. 46 is a rear view of the locking liner plate of FIG. 44, showing details of the angle extension, according to the invention.
Figure 47:
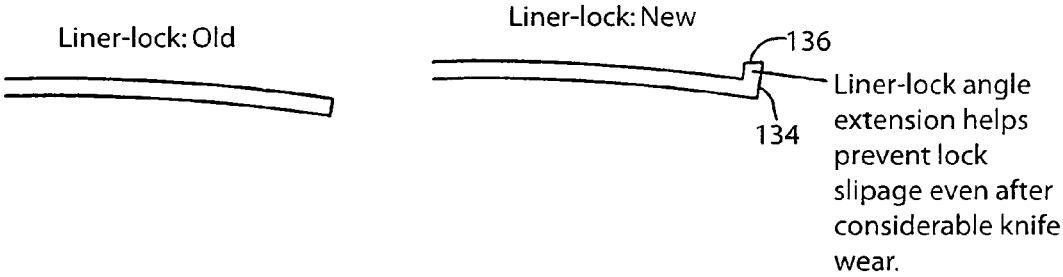
FIG. 47 is a partial top view of a locking tab, showing details of the angle extension, according to the invention.
Figure 48:
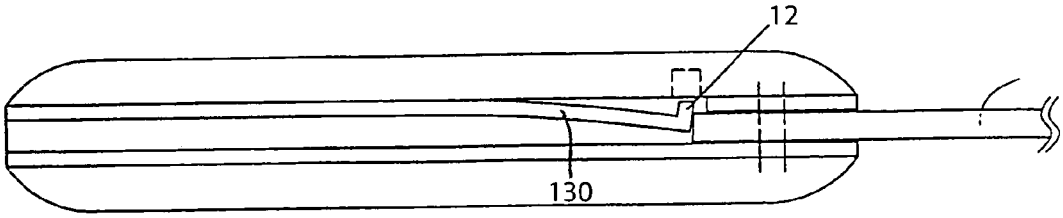
FIG. 48 is a top view of a knife showing a blade in a fully open position and a locking tab positioned in a locked position abutting the tang of the blade, and further showing (in phantom) a recess formed in a handle plate used to accommodate the angle extension when positioned in a stowed, unlocked position, according to the invention.
Figure 49:
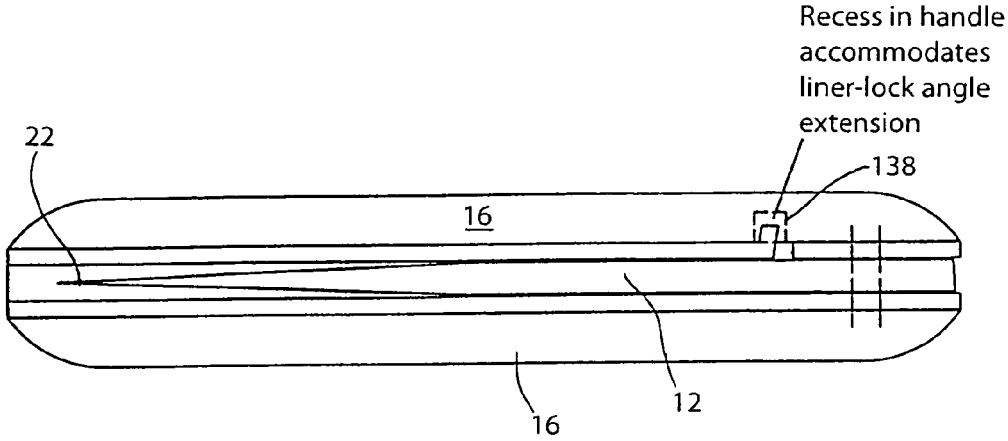
FIG. 49 is a top view of a knife showing a blade in a closed position and a locking tab positioned in the stowed, unlocked position with the angle extension positioned within the recess formed within the handle plate, according to the invention.

Referring to FIGS. 40, 41; and 42, an angle-extension 136 is provided to overcome this potential problem. By effectively widening locking edge 134 of tab 130 (at least wider than the width of recess 34), locking edge 134 cannot enter recess 34 and the liner-locking system will not fail. Referring to FIGS. 47, 48, and 49, to accommodate the angle extension 136 of liner lock tab 130, a recess 138 is formed within the adjacent handle plate 16, as shown in FIGS. 48 and 49. Angle extension 136 is preferably formed integrally with the formation of tab 130, by forming a bend 140 near the locking edge 134, as shown in FIGS. 43–46, but may also be attached to tab 130 as a separate element. Also, angle extension 136 may be strengthened by welding the inside comer of the angle extension 136 against tab 130.

As suggested by FIGS. 47, 48, and 49, in accordance with another embodiment of the invention, angle extension 136 may be provided on the tab portion of any liner lock system for any type of folding knife, regardless if the tang of the blade is slotted or remains solid. Angle extension 136 will help prevent the locking edge of any prior art liner lock from slipping from its abutted position.

Figure 50:
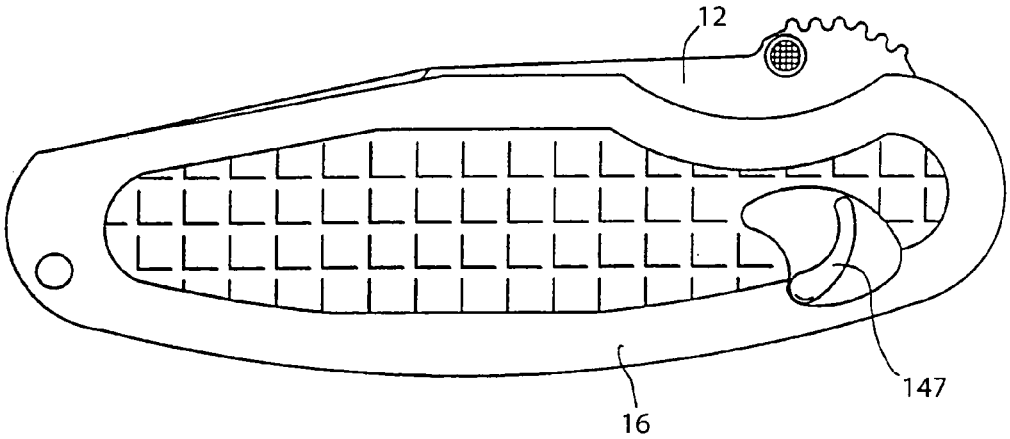
FIG. 50 is a side view of a knife, according to yet another embodiment of the invention, showing details of an accessible lever arm (shown in an unlocked position) and a blade located in a closed position.
Figure 51:
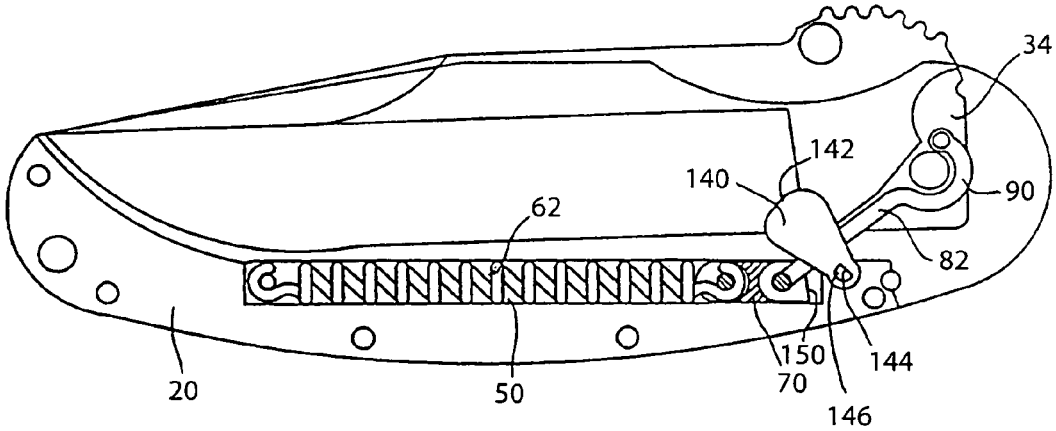
FIG. 51 is a side view of the knife of FIG. 50, shown without a liner plate or a handle plate, thereby revealing details of a blade locking mechanism (shown located in an unlocked position), according to the invention.
Figure 52:
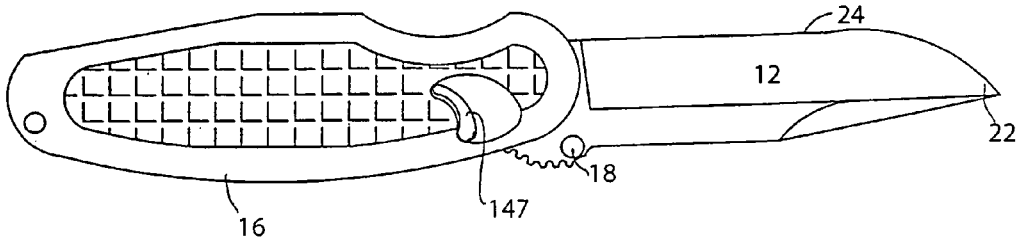
FIG. 52 is a side view of the knife of FIG. 50 showing the blade in a fully position and showing the lever arm in a locked position, according to the invention.
Figure 53:
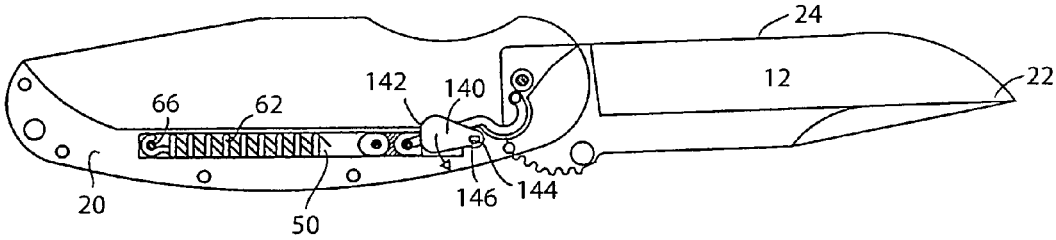
FIG. 53 is a side view of the knife of FIG. 51, shown without a liner plate or a handle plate, thereby revealing details of the blade locking mechanism (shown in a locked position, engaged with a linkage), according to the invention.
Figure 54:
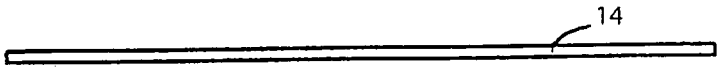
FIG. 54 is a top view of a non-locking liner plate, according to the invention.
Figure 55:
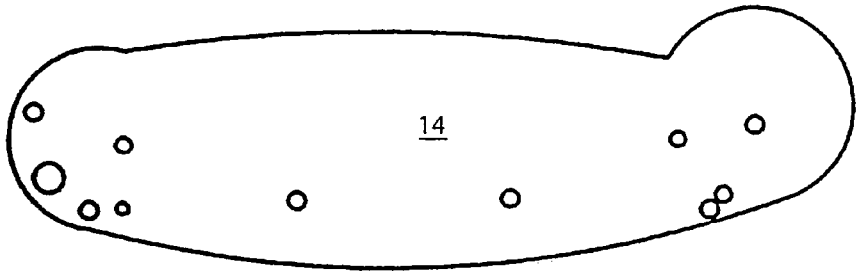
FIG. 55 is a side front view of the non-locking liner plate, according to the invention.
Figure 56:
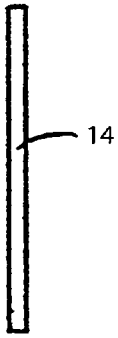
FIG. 56 is a front view of the non-locking liner plate, according to the invention.
Figure 57:
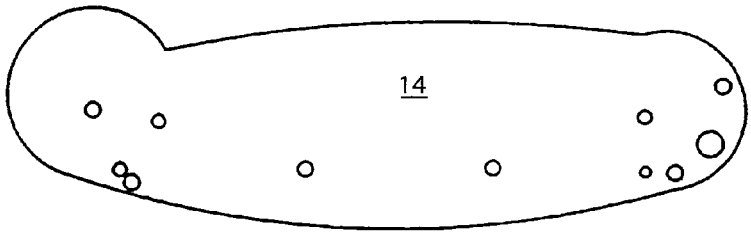
FIG. 57 is a rear view of the non-locking liner plate, according to the invention.
Figure 58:
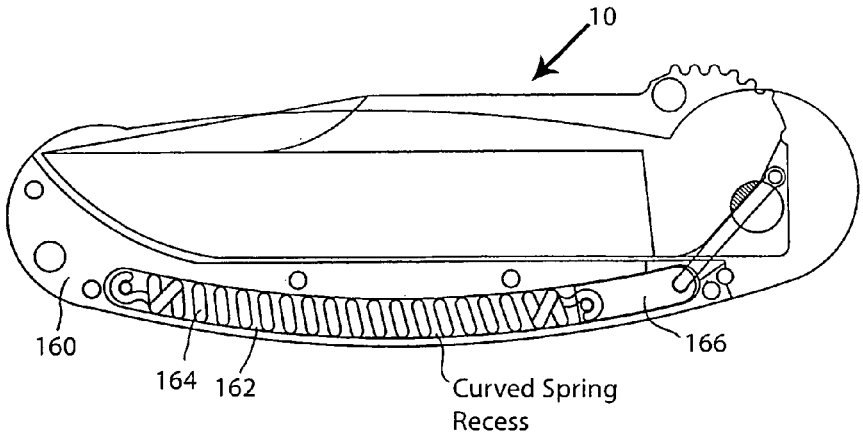
FIG. 58 is a side view of a knife, according to yet another embodiment of the invention (shown without a liner plate or a handle plate thereby revealing details of a spring assisted mechanism), including a spring located within a curved spring recess, wherein the blade of the knife is in a closed position.
Figure 59:
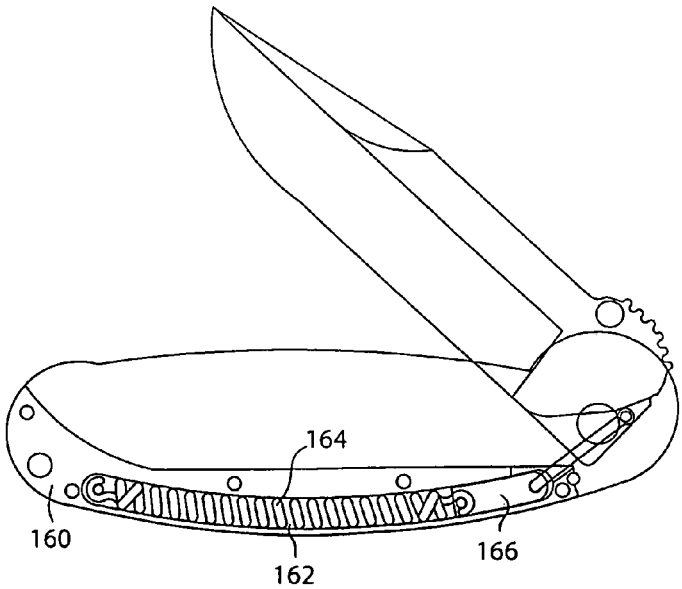
FIG. 59 is a side view of the knife of FIG. 58, wherein the knife blade is positioned outside a blade receiving cavity, yet is not at its fully opened position.

Referring now to FIGS. 50, 51, 52, and 53, a knife locking system according to yet another embodiment of the invention, includes a pivotal locking element 140 which is arranged to selectively engage a portion of linkage 70 when blade 12 reaches its fully open position. Locking element 140 is preferably positioned between a handle plate 16 and a liner plate 14 (an appropriate recess (not shown) is formed within handle plate 16 to accommodate locking element 140). Locking element 140 includes an engaging edge 142 and a pivot opening 144. An accessible lever arm 146 is provided on an outside surface 148 of handle plate 16, as shown in FIGS. 50 and 52. A pivot pin 146 is provided to mechanically connect accessible lever arm 146 and locking element 140. An appropriate spring (not shown) is used to exert a counterclockwise bias to both locking element 140 and lever arm 146. When knife blade 12 is in any position except its fully open position, the counterclockwise bias causes locking element 140 to effectively engage an upper surface of linkage 70. As blade 12 is rotated from its fully closed position to its fully open position, linkage 70 will linearly displace within spring recess 50, as described above. When blade 12 reaches the fully open position, as shown in FIG. 53, linkage 70 reaches a point that allows locking element 140 to rotate into engagement with a front surface 150 of linkage 70. This engagement prevents any return, forward movement of linkage 70 within spring recess 50, thereby effectively locking blade 12 in its fully open position. A user merely has to rotate the accessible lever arm 146 clockwise to angularly displace locking element 140 from its engagement with linkage 70. This action thereby releases the lock to linkage 70 and blade 12 so that blade 12 can thereafter be returned to its closed position, shown in FIG. 50. Applicant prefers that a locking element 140 is provided on both sides of blade 12 and either operate together or separately (separately operating locking elements 140 will provide a locking system that is less likely to accidentally release). In order for locking elements 140 to engage with linkage 70, linkage 70 must be made sufficiently wide so that at least a portion of linkage 70 extends past liner plate 14 (or both plates 14) and into the handle plate 16 (within a recess formed within handle plate 16, not shown).

Applicant has provided the above locking systems as suggestions. Of course, other locking arrangements may be implemented without departing from the invention, such as locking systems that use aligned slots formed within the liner plates and a particularly shaped rod to provide an effectively lock to the blade. Such a system is shown in U.S. Pat. No. 6,079,106 of Vallotton and its entire content is hereby incorporated by reference.

Although preferred embodiments of this invention have been disclosed, it will be appreciated that further variations and modifications may be made thereto without departing from the scope of the invention.

What is claimed is:

1. A folding knife, comprising:

a handle defining a longitudinal axis, a knife-receiving chamber, and a spring chamber, said handle supporting a pivot pin;

a blade having a tip end and a tang end, said tang end being pivotally attached to said handle about said pivot pin between a recessed position, wherein said blade resides within said knife-receiving chamber of said handle, and a usable position wherein said blade resides outside of said handle and inline with said longitudinal axis, said tang end of said blade including a slotted recess;

a spring located within said spring chamber, said spring including a first end that is connected to said body of said handle and a second end; and a linkage including a first part and a second part, with said first part being connected to said tang end of said blade within said slotted recess and said second part being confined within said spring chamber and pivotally attached to said second end of said spring so that said spring force applies a pivotal force to said blade, said first part defining a tang end of said linkage and being pivotally attached to said second part as well as to said knife blade to provide an over-center arrangement with respect to said knife so that when said knife blade is within said knife-receiving chamber, said spring force causes said knife blade to remain in said handle, and when said knife blade is positioned about said pivot pin to a predetermined angle with respect to said longitudinal axis, said spring force causes said blade to open quickly to its usable position, said linkage and said spring being positioned and operating in alignment with the plane of the blade.

2. The folding knife of claim 1, wherein said blade includes an opening for receiving a pivot associated with said linkage for pivotally coupling said linkage to said blade.

3. The folding knife of claim 1, wherein said blade includes opposing pins that project outwardly from said blade and serve as the pivot pin that permits said blade to pivot about said handle.

4. The folding knife of claim 1, further including:

a coupling member for connecting said tang of the blade to said linkage.

5. The folding knife of claim 4, wherein said linkage is movably disposed within said spring chamber.

6. The folding knife of claim 4, wherein said coupling member comprises a connecting rod having a straight lower end and a curved top end that is received within said slotted recess, said rod including an upper bore formed therethrough to receive a pin for pivotally attaching said rod to said tang and a lower bore formed therethrough to receive a pin for pivotally attaching said rod to said linkage.

7. The folding knife of claim 6, wherein in the usable position, said curved top end of said rod received and accommodates said pivot pin.

8. A folding knife, comprising:

a handle defining a longitudinal axis, a knife-receiving chamber, and a spring chamber, said handle supporting a pivot pin;

a blade having a tip end and a tang end, said tang end being pivotally attached to said handle about said pivot pin between a recessed position, wherein said blade resides within said knife-receiving chamber of said handle, and a usable position wherein said blade resides outside of said handle and inline with said longitudinal axis, said tang end of said blade including a slotted recess;

a spring located within said spring chamber, said spring including a first end that is connected to said body of said handle and a second end; and a linkage connecting said tang end of said blade within said slotted recess to said second end of said spring so that said spring force applies a pivotal force to said blade, a tang end of said linkage being attached to said knife blade to provide an over-center arrangement with respect to said knife so that when said knife blade is within said knife-receiving chamber, said spring force causes said knife blade to remain in said handle, and when said knife blade is positioned about said pivot pin to a predetermined angle with respect to said longitudinal axis, said spring force causes said blade to open quickly to its usable position, said linkage and said spring being positioned and operating in alignment with the plane of the blade, wherein said linkage includes a front vertical slot and a rear vertical slot and a pair of lateral bores which are constructed to receive complementary lateral pins.

9. The folding knife of claim 8, wherein said second end of said spring is positioned within said rear vertical slot secured therein by one of said lateral pins.

10. A folding knife, comprising:

a handle defining a longitudinal axis, a knife-receiving chamber, and a spring chamber, said handle supporting a pivot pin;

a blade having a tip end and a tang end, said tang end being pivotally attached to said handle about said pivot pin between a recessed position, wherein said blade resides within said knife-receiving chamber of said handle, and a usable position wherein said blade resides outside of said handle and inline with said longitudinal axis, said tang end of said blade including a slotted recess;

a spring located within said spring chamber, said spring including a first end that is connected to said body of said handle and a second end; and a linkage connecting said tang end of said blade within said slotted recess to said second end of said spring so that said spring force applies a pivotal force to said blade, a tang end of said linkage being attached to said knife blade to provide an over-center arrangement with respect to said knife so that when said knife blade is within said knife-receiving chamber, said spring force causes said knife blade to remain in said handle, and when said knife blade is positioned about said pivot pin to a predetermined angle with respect to said longitudinal axis, said spring force causes said blade to open quickly to its usable position, said linkage and said spring being positioned and operating in alignment with the plane of the blade;

a connecting rod having a first end that is disposed within said slotted recess and pivotally attached to said tang of said blade and a second end that is pivotally attached to said linkage which is slidably contained within said spring chamber, wherein a line of equilibrium is defined as a line intersecting both an axis of said pivot pin and a first pivot point defined where said connecting rod pivotally connects with said linkage, wherein when said blade is in the fully recessed position, an axis of a second pivot point defined where said connecting rod pivotally connects with said blade is positioned above said pivot pin axis and to the rear of said line of equilibrium so as to cause said spring to apply a rearwardly directed spring bias to said linkage which, in turn, causes said connecting rod to force said blade to rotate counterclockwise towards its fully recessed position.

11. The folding knife of claim 10, wherein as said blade is rotated about the pivot pin axis, the axis of the second pivot pin rotates about the pivot pin axis, advancing towards said line of equilibrium until it resides on the line of equilibrium at which position, a turning point of said blade is defined and after which, said spring no longer causes blade to rotate counterclockwise but instead said spring creates a bias that causes said blade to rotate clockwise until it locks at its usable position.

12. A folding knife, comprising:

a handle defining a longitudinal axis, a knife-receiving chamber, and a spring chamber, said handle supporting a pivot pin;

a blade having a tip end and a tang end, said tang end being pivotally attached to said handle about said pivot pin between a recessed position, wherein said blade resides within said knife-receiving chamber of said handle, and a usable position wherein said blade resides outside of said handle and inline with said longitudinal axis, said tang end of said blade including a slotted recess;

a spring located within said spring chamber, said spring including a first end that is connected to said body of said handle and a second end, the spring generating a force that applies a pivotal force to the blade such that when said blade is within said knife-receiving, the spring force causes the blade to remain therein;

a linkage connected to the second end of the spring and to a connecting rod that is pivotally connected to said linkage and is also pivotally connected to said tang end of said blade within said slotted recess; and wherein a line of equilibrium is defined as a line intersecting both an axis of said pivot pin and a first pivot point defined where said connecting rod pivotally connects with said linkage, a second pivot point being defined where said connecting rod pivotally connects with said blade, a turning point of said blade being defined as a position where an axis of a second pivot point resides on said line of equilibrium, wherein as the second pivot point rotates about the pivot pin axis beyond the turning point, said spring no longer causes said blade to rotate counterclockwise but instead said spring causes a bias that causes said blade to rotate clockwise until said blade locks at its usable position and when the second pivot point rotates in an opposite direction about the pivot pin axis beyond the turning point, said spring creates a bias that causes said blade to rotate counterclockwise until it locks in its fully recessed position.

* * * * *